US011608685B2

(12) United States Patent
Kirk

(10) Patent No.: US 11,608,685 B2
(45) Date of Patent: Mar. 21, 2023

(54) CUTTING HEAD AND METHOD FOR HORIZONTAL DIRECTIONAL TUNNELING

(71) Applicant: Charles E Kirk, Columbus, OH (US)

(72) Inventor: Charles E Kirk, Columbus, OH (US)

( * ) Notice: Subject to any disclaimer, the term of this patent is extended or adjusted under 35 U.S.C. 154(b) by 0 days.

(21) Appl. No.: 17/085,472

(22) Filed: Oct. 30, 2020

(65) Prior Publication Data

US 2022/0136330 A1 May 5, 2022

(51) Int. Cl.

| | |
|---|---|
| ***E21B 7/04*** | (2006.01) |
| ***E21B 7/28*** | (2006.01) |
| ***E21B 7/20*** | (2006.01) |
| ***E21B 10/26*** | (2006.01) |
| ***E21B 3/02*** | (2006.01) |

(52) U.S. Cl.

CPC ..... *E21B 7/046* (2013.01); *E21B 3/02* (2013.01); *E21B 7/201* (2013.01); *E21B 7/28* (2013.01); *E21B 10/26* (2013.01)

(58) Field of Classification Search

CPC . E21B 7/046; E21B 3/02; E21B 7/201; E21B 7/28; E21B 10/26

See application file for complete search history.

(56) References Cited

U.S. PATENT DOCUMENTS 2,647,597 A * 8/1953 Keese ..... B60K 5/04 192/218
4,679,637 A * 7/1987 Cherrington ..... E21B 7/18 175/61
5,096,002 A * 3/1992 Cherrington ..... E21B 7/20 175/53
5,375,669 A * 12/1994 Cherrington ..... E21B 7/28 175/102
10,113,369 B1 10/2018 Barbera
10,180,031 B2 1/2019 Engle (Continued)

FOREIGN PATENT DOCUMENTS

WO WO-2015134689 A1 * 9/2015 ..... E21B 7/20

OTHER PUBLICATIONS

Microtunneling [online] definition from Wikipedia [retrieved (May 4, 2020)] retrieved from (en.wikipedia.org/wiki/Microtunneling).

(Continued)

*Primary Examiner* — Taras P Bemko
*Assistant Examiner* — Ronald R Runyan
(74) *Attorney, Agent, or Firm* — Frank H. Foster; Kremblas & Foster

(57) ABSTRACT

A cutting head has a mounting bracket for attachment to a pipe and a cutter wheel. A double tapered bearing is connected between the mounting bracket and the cutter wheel. The bearing allows the cutter wheel to be rotated without rotation of the pipe. A drive shaft connector on the cutter wheel is connectable to a pilot hole drive shaft for rotating the cutter wheel and pulling it and the pipe. A pilot hole is drilled in a conventional manner. The pipe is attached to the mounting bracket and an end of the pilot hole drive shaft is then connected to the cutter wheel. Simultaneously the pilot hole is enlarged and the pipe and cutter wheel are pulled along the enlarged hole by the drive shaft. The cutter wheel advances along the pilot hole and the pipe is simultaneously advanced through the enlarged hole immediately behind the cutter wheel.

11 Claims, 3 Drawing Sheets

(56) References Cited

U.S. PATENT DOCUMENTS

| | | | | |
|---|---|---|---|---|
| 2002/0066598 | A1* | 6/2002 | Rozendaal | E21B 7/046 175/61 |
| 2004/0188142 | A1* | 9/2004 | Self | E21B 7/06 175/406 |
| 2008/0073123 | A1* | 3/2008 | Mullins | E21B 17/22 175/323 |
| 2018/0163475 | A1* | 6/2018 | Barbera | E21B 7/20 |

OTHER PUBLICATIONS

"7. Directional Drilling and Tunneling." National Research Council. 1994. Drilling and Excavation Technologies for the Future. Washington, DC: The National Academies Press, doi: 10.17226/2349.

* cited by examiner

CUTTING HEAD AND METHOD FOR HORIZONTAL DIRECTIONAL TUNNELING

BACKGROUND OF THE INVENTION

This invention relates to equipment and methods for boring, drilling or tunneling under the earth's surface to form a hole from one surface location to another surface location and for placing a utility pipe or conduit through the hole. There are many different systems for performing those operations. The choice of which of the large variety of methods and equipment to use is dependent upon the length of the hole, the soil conditions, the grade and potential environmental consequences.

The cost of a project is also an important consideration for governmental agencies and utilities that contract for these projects and therefore is also an important factor for the contractors who must choose the equipment and the method they would use for each project before submitting a bid. The total cost of a project is based on two principal expenses. The first is the cost of the equipment that is used and the second is the cost of operating the equipment. Operating costs are based on the length of time that is necessary to complete the project, the number of employees and the number of man-hours that are required. These costs vary greatly over a very wide range. Consequently, improvements are desirable that reduce the necessary man-hours and/or allow less costly equipment to be used for projects for which conventional practices use more costly equipment.

Directional boring and horizontal directional drilling (HDD) are minimal impact trenchless methods of installing underground utilities such as pipe, conduit, or cables in a relatively shallow arc along an underground path using a surface-launched drilling rig. The terms directional boring and horizontal directional drilling imply different scales. The terms "Directional Boring" and "Bore" imply crossings of hundreds of feet. The term Horizontal Directional Drilling (HDD) implies larger drilling rigs, large diameter bores, and crossing lengths in terms of thousands of feet. HDD uses surface launched machines for small pipe and large pipe while using the hole as a pressure line to remove cuttings. These bores can be 50 feet to 15,000 feet.

A common component of most equipment for directional drilling and boring is a cutting head. A cutting head is a grinding tool assembly that grinds through earth to form a horizontal hole. The prior art has disclosed many different kinds of cutting heads. A cutting head includes a cutter wheel, with protruding teeth or roller cones, that is driven in rotation and pushed along a path to form the hole. In some systems the cutter wheel is a reamer that is attached to a drive shaft (e.g. drive rod or drive pipe) and is pushed through the earth or pulled through a pilot hole without any attachment to a pipe (other than a drive pipe for rotating the cutter wheel).

One type of system for boring a generally horizontal hole is auger boring which is not guided and usually does not use a pilot hole. Auger bores are typically good for 100 feet up to possibly 300 feet under a railroad track or other surface structure. In prior art auger systems, the cutter wheel is attached to an auger which is pushed from an entrance end of the hole and driven in rotation. The pushing while rotating advances the hole and the rotation of the auger removes the cuttings. The contractor may dig a pit, place an auger inside a casing pipe and attach a cutting head to the entry end of the auger. The cutter wheel is spaced approximately an inch ahead of the casing pipe and has a slightly larger radius than the casing pipe. The casing pipe and the auger with the attached cutting head are jacked horizontally into the earth for accomplishing the drilling operation. An auger boring machine is the driver at the pit that rotates the auger and with it the cutter wheel. The cut material is removed through the auger flights, which are the continuous one-piece helicoid screw segments of the auger. Periodically the contractor backs up the auger boring machine, adds another segment of casing pipe with an auger in it and continues drilling and repeating that operating sequence.

An auger bore system is not remotely steerable. Consequently, ground conditions periodically cause the drilling path to deviate from the desired path. For example, if a cutter wheel moves against a rock that has soft soil next to it, the rock deflects the cutter wheel and the casing pipe away from the rock and away from the intended path. Additionally, since the cutter wheel radius is greater than the casing pipe radius, gravity pulls the cutting direction downward. Therefore, in order for a contractor to determine whether the desired drilling path is being followed, the contractor periodically withdraws the auger from the casing pipe and shoots a laser through the casing pipe to see if the cutter wheel has deviated from the desired drilling path. If the travel path of the bored hole has deviated, workers must climb into the hole and use hand tools to cut away the rock. They may also jack wedges in between the casing pipe and the wall of the hole in order to deflect the casing pipe and the cutting head to direct the subsequent path of the cutter wheel back to the desired drilling path. The periodic removal of auger flights, followed by laser testing to determine the track of the hole, entering the hole to change the path of the cutter wheel and replacing the auger flights to continue boring are all time consuming and labor intensive operations which add greatly to a project's cost. Consequently it would be desirable to have an apparatus and method for maintaining the bore path of an auger system along a desired path without requiring those time-consuming and labor-intensive operations.

After the cutting head and the casing pipe are advanced to the exit hole ("all the way over") the workers remove the cutter wheel from the auger or retract the cutter wheel while pulling out all the auger segments. The workers then either remove the casing pipe and replace it with a service or product pipe or insert the service or product pipe through the casing pipe.

To complete an auger bore, a contractor must use a casing pipe and thread it with augers. If a utility is going to be inserted inside this casing pipe, then the casing pipe can stay in place once the augers are removed. If a product pipe, such as a high-pressure gas line, is to replace the casing pipe, then a gas pipe with a special coating is welded to the casing pipe and both are pushed by the auger boring machine. This operation of welding on gas pipe and shoving out casing pipe continues until the gas pipe reaches the exit pit with the slurry type machine. As will be seen, with the invention the contractor can go straight to the product pipe, saving time.

There have also been auger systems that use a water and clay (Bentonite) slurry to reduce the skin friction between the casing pipe and the wall of the hole. The slurry is pumped into the hole around the outside of the casing pipe and the cuttings are carried out by the auger.

Another prior art system for constructing a hole from one surface location to another surface location is horizontal directional drilling (HDD). HDD is preferred for longer holes, such as under a river, and often uses a slurry to assist in removing cuttings. Prior art HDD begins with drilling a pilot hole in a manner that is well known in the prior art. The next step is to "pre-ream" which is enlarging the pilot hole so it will accept a product or service pipe. A cutting head (or "reamer") is attached to a drive shaft which is driven in rotation to rotate the cutter wheel of the cutting head. There are two ways to pre-ream: push ream or pull ream. The cutting head is pushed through the earth or is pulled through the pilot hole with a pilot drive shaft. There is no pipe associated with this pre-ream operation, just the cutting wheel and its drive shaft. The diameter of the cutter wheel that makes the enlarged hole is typically considerably larger (e.g. 1.5 times) than the product or service pipe to be installed. The reason for the considerable oversize is that the typical HDD project runs a considerable length so skin friction between the pipe and the wall of the hole can be large and cause considerable resistance to subsequent insertion of the product or service pipe. The more the hole diameter exceeds the pipe diameter the less the skin friction between a pipe and the hole. In some cases the hole diameter may be enlarged in sequential stages each time with a larger cutter wheel. After reaming is completed, a product or service pipe is either jacked or pulled through the enlarged hole.

In order to help carry out the cuttings in the HDD system, a slurry is pumped into the hole to the cutter wheel through a drive shaft that is a drill pipe. The slurry is forced through the cutting head to clean the cutter and carry away cuttings. Typically the hole follows an arc from an entrance end to an exit end. For example, the arc inclines downward from its entrance end, curves and passes under a river and then turns upward to its exit end. The slurry rises in and fills the hole until its surface level rises in the pit at the entrance end or exit end of the hole at the upper ends of the arc. The slurry, which is carrying the cuttings, is then pumped out of the pit from the slurry surface.

As a result of this arrangement, the slurry that is backed up in the hole has a height in the hole from the bottom of the arc to the slurry surface at an end pit. Therefore, the slurry has a high hydraulic fluid pressure at the bottom of the hole. That pressure is proportional to the height of the slurry surface above the bottom of the hole. Therefore, the hydraulic pressure is highest at the bottom of the arc, such as directly under a river. Because the slurry with the cuttings is drawn out with a vacuum truck only from its surface level at an end of the hole, a high hydraulic pressure remains at the lower segment of the hole. The earthen interior wall of the hole is acting as a pressure line and provides the only containment for the slurry.

A major problem arises when the liquid slurry immediately under a river is under a high pressure that is applied to the soil surrounding a hole. If the slurry surface level at the entrance or exit of the hole is at a higher elevation than the surface level of the river, which it usually is, the slurry can fracture through the hole wall and the river bed and flow into the river. Because of this fracking risk and the contamination that can result, the HDD system is often prohibited by a governmental environmental agency.

For the purpose of avoiding the fracking describes above, there is a system called microtunneling. The microtunneling system is designed to eliminate fracking but requires multimillion dollar equipment with very complicated structures including crushing chambers, steering systems, hydraulic or electric motors inside the pipe at the cutting heads to operate them, and electric or hydraulic lines through the hole to power the motors. Although microtunneling works fine for large projects requiring a large hole, the cost of microtunneling makes it impractical for use on many smaller jobs.

In microtunneling, a cutting head is mounted to and extends ahead of a product, service or casing pipe. The pipe is jacked into the earth to advance the cutting head and the pipe into the earth and form the hole. A steering mechanism is typically also attached to the cutting head. The cutting head is driven in either of two general ways. In one way, the cutting head is driven by one or more electric motors or hydraulic motors that power the cutter wheels. For example a cutting head has rotating cutter wheels that are driven in rotation by hydraulic motors. In some systems electric motors are substituted for hydraulic motors. For a hydraulic system, hydraulic hoses extend through the pipe to deliver high pressure hydraulic fluid to the motors and to return the low pressure hydraulic fluid to the hydraulic pump at the entrance end of the hole. For electric motor systems, wires carrying electric current extend through the interior of the pipe. In an alternative way, a cutter wheel is rotated by a drive shaft extending into the hole from the entrance end of the hole. The drive shaft has segments that are linked end to end and links are added as the length of the holes progresses.

Because microtunneling is used for horizontal holes that are quite long and often the pipes are much larger in diameter, skin friction between the outer pipe surface and the inner wall of the hole through the earth becomes a major factor in trying to jack the pipe through the hole. Slurry with Bentonite is directed to flow around the outside of the pipe in order to reduce the skin friction. A separate slurry delivery pipe runs along inside the product pipe to deliver the Bentonite slurry mix along the annular space surrounding the product pipe. The slurry mix is pumped along the outside of the product pipe and pumped to the cutter wheel. The heavy Bentonite slurry mix shields cuttings, which are coming off the cutting action of the cutter wheel, from migrating along the outside of the product pipe. The purpose is to keep clean Bentonite slurry with less than 0.05% sand content along the outside of the product pipe in order to reduce skin friction forces and force dirty sand and grout cuttings to the inside of the microtunnel cutter wheel. Clean water without Bentonite is delivered to the cutting head through an inside water delivery pipe. As an alternative, a drive pipe, which rotates a cutter wheel, runs through the pipe and carries slurry to the cutting head.

The slurry is returned from the cutter head through a slurry return pipe that lies along the bottom interior of the product pipe. Because in microtunneling they are pushing the pipe, they have to cut a hole that is not much larger than the pipe (e.g. 31½ inch hole for a 30 inch pipe). Otherwise the pipe would keep falling by gravity and be continuously diverted downwardly. So the portion of the slurry that is between the pipe and the earthen hole wall is under hydraulic pressure.

No prior art system is known that simultaneously pulls, by a drive shaft through the pilot hole, the combination of a cutter head and a pipe with the cutter wheel being rotated independently of the pipe so the pipe is not rotated.

SUMMARY OF THE INVENTION

The invention provides an apparatus and a method for permitting the simultaneous combination of: (1) pulling and rotating a cutter wheel to ream and enlarge a horizontal pilot hole; (2) pulling a pipe along behind the cutter wheel through the enlarged hole as it is being enlarged; (3) using one drive shaft to simultaneously do the pulling and rotating operations; and (4) doing those operations with that drive shaft extending through a pilot hole.

The apparatus of the invention is a cutting head for attachment at an end of a pipe and for pulling on the pipe and the cutting head with a drive shaft that extends through a pre-formed pilot hole. The cutting head has a mounting bracket configured for attachment of the cutting head to the pipe and has a cutter wheel that is rotated by the drive shaft. The cutter wheel has a radius larger than the radius of the pipe so the pipe can be pulled along an enlarged hole as the hole is being bored by the cutter wheel. A bearing connects the cutter wheel to the mounting bracket. That bearing has a rotatable component that is connected to the cutter wheel and rotatable around a central axis. The bearing also has a stationary component attached to the mounting bracket. The bearing allows the cutter wheel to be driven in rotation without rotation of the pipe while allowing the pipe to be pulled. A drive shaft connector is fastened on the opposite side of the cutter wheel from the mounting bracket for attachment of the cutter wheel to a pilot hole drive shaft.

The method for using the apparatus of the invention for laying an underground pipe begins with drilling a pilot hole from an entrance location to an exit location in a conventional manner. An end of the pilot hole drive shaft is connected to the cutter wheel. Then, simultaneously the pilot hole is enlarged and the pipe is pulled into the enlarged hole by pulling on the cutter wheel with the drive shaft and rotating the cutter wheel with the drive shaft without rotating the pipe. In that manner the cutter wheel advances along the pilot hole and the pipe is simultaneously advanced through the enlarged hole immediately behind the cutter wheel.

Figure 1:
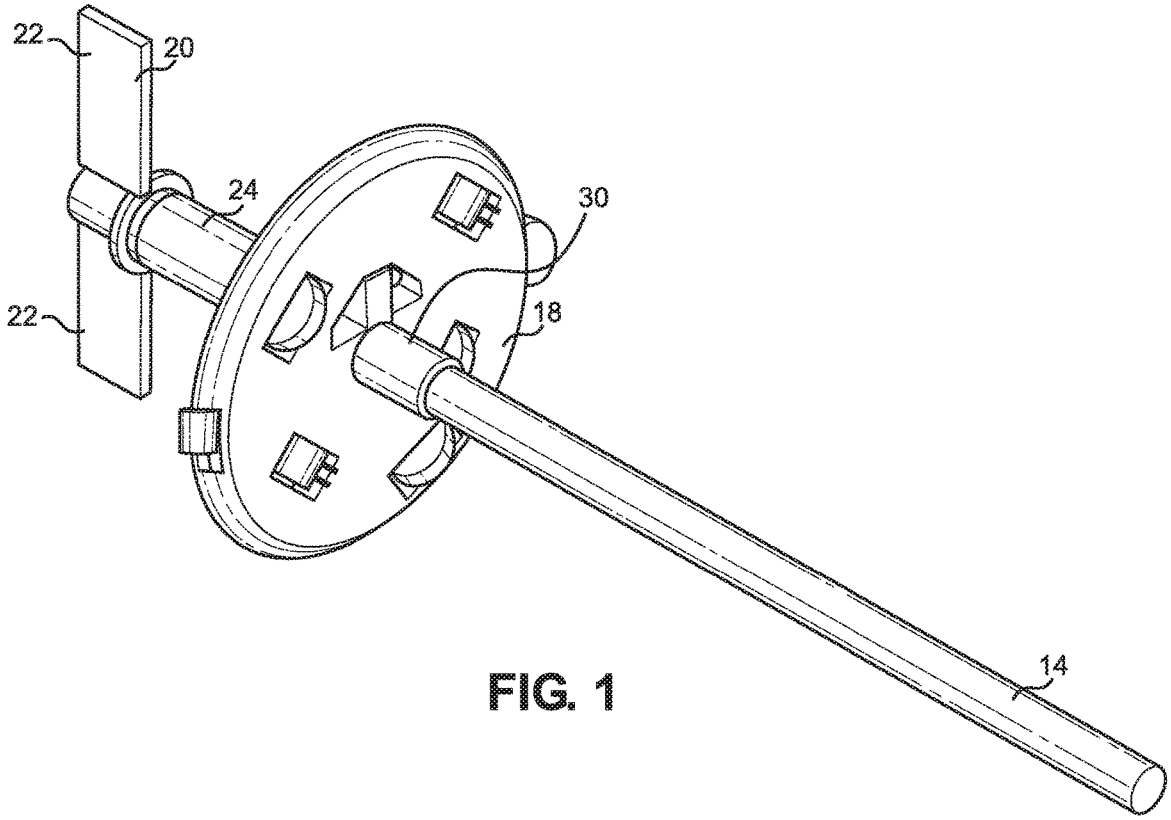
FIG. 1 is a FIG. 1 is a view in perspective of an embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

This description of the preferred embodiments of the invention begins with a discussion of some of the terminology used in the descriptions.

The term "pipe" is applied to a variety of elongated tubular structures in the technology of boring and drilling in the earth. A product pipe, service pipe or carrier pipe is a pipe that is being installed and will remain and carry a liquid or utilities when an installation is completed. A casing pipe or false pipe is a pipe that is installed in a hole but is later removed and replaced by another pipe or is retained in the hole to provide surrounding protection for a product, service or carrier pipe. An example is a casing pipe that surrounds an auger. The term "pipe", when not modified by an adjective, is used in this document to refer a pipe (or conduit) of the type described above. Except when modified by an adjective, the term "pipe" does not refer a smaller pipe that performs a different function such as a slurry input pipe, a slurry return pipe or a drill pipe.

The term "drive shaft" is used to refer generically to a drill rod, a drill pipe or similar mechanical component. A drive shaft is typically a series of elongated mechanical drive elements that are connected end to end and used to drive in rotation a machine component at one end of the drive shaft by a drive engine or motor at its other end. The term "drill pipe" indicates that the drive shaft has an interior passage through which a liquid can be pumped, although drill pipes are sometimes referred to drill rods. The term drive shaft can also refer to a "drill string". Individual lengths of drive shaft, pipes or augers are also referred to as "flights".

The term "cutting head" is used to refer to an assembly of component parts that includes a cutter wheel and other components. The term "cutter wheel" refers to the structure that does the grinding of the earth into cuttings that are removed from a hole as the cutter wheel progresses through the earth to form a hole such as a pilot hole or an enlarged hole. A cutter wheel is typically a wheel with teeth or other protruding cutters such as roller cones. The invention is not directed to any feature of a cutter wheel and can use many of the cutter wheels already known in the prior art.

Cutting Head and Attached Pipe

Figure 2:
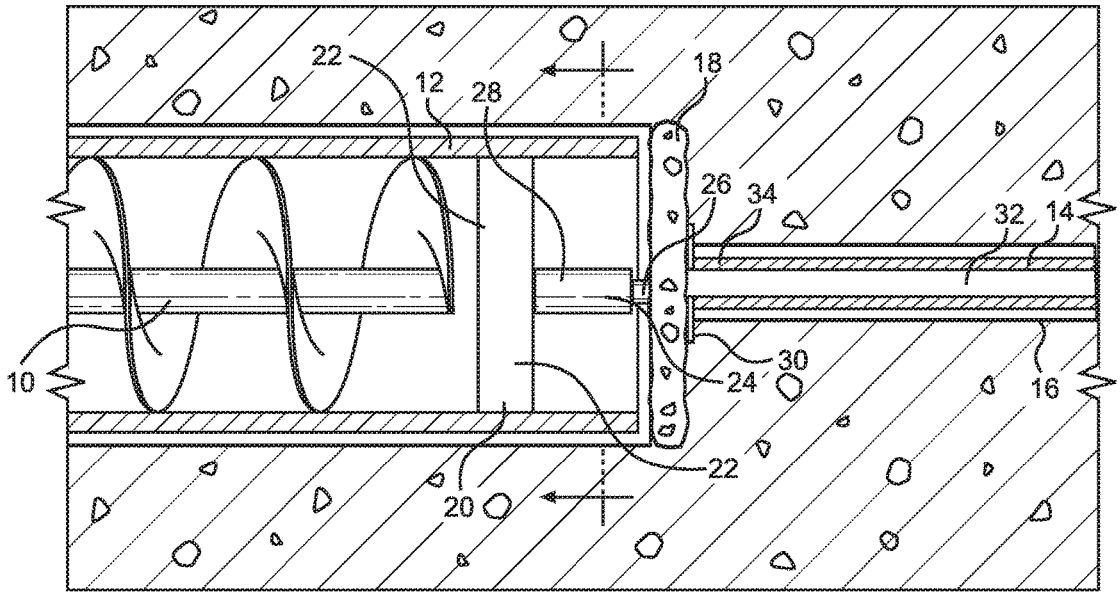
FIG. 2 is a view in section of the embodiment of FIG. 1 taken substantially along the line 2-2 of FIG. 4.

FIG. 1 illustrates a cutting head for use with an auger system and FIG. 2 illustrates that cutting head attached to an auger 10 and to a pipe 12. The cutting head is at the end of the pipe 12 so that a drive shaft 14, which extends through a preformed pilot hole 16, can simultaneously: (1) rotate and pull a cutter wheel 18 in order to enlarge the pilot hole 16 and advance the enlarged hole; and (2) pull the pipe 12 behind the cutter wheel 18 and along the enlarged hole as the enlarged hole is being advanced along the pilot hole 16.

The cutting head has a mounting bracket 20 that is configured for attachment of the cutting head to the pipe 12. The mounting bracket 20 preferably is configured for attachment to an interior wall of the pipe 12. For that purpose the mounting bracket 20 desirably has arms that extend radially outward from a central axis of the auger 10 by a radial distance equal to the interior radius of the pipe 12. The preferred mounting bracket 20 has two, oppositely extending, radial arms 22 each extending outwardly from the central axis by the radial distance equal to the interior radius of the pipe. There could be three or more radial arms but it is necessary that they are sufficiently spaced apart so that cuttings can pass between the radial arms from the cutter wheel 18 into the auger 10.

The mounting bracket 20 can be attached to the pipe 12 by various attachment means such as by welding at the peripheral ends of its arms or by bolts extending through flanges formed at the ends of the arms. The mounting bracket 20 is preferably connected to the interior of the pipe 12. The mounting bracket could be connected to the end of a pipe or even the exterior of a pipe. However, connection other than to the interior of the pipe 12 is considerably less desirable because such a connection could interfere with hole alignment and with the movement of the pipe along an enlarged hole.

The cutter wheel 18 is a component of the cutting head and has a radius larger than the radius of the exterior surface of the pipe 12. That dimensional relationship allows the pipe 12 to be pulled along a hole as the hole is being enlarged by the cutter wheel 18. As in the prior art, the cutter wheel 18 has holes or passages in order to pass cuttings through it and into pipe 12. The cutter wheel 18 is spaced in front of the casing pipe 12 by a small space (e.g. ¾ inch) to avoid frictional contact between the cutter wheel 18 and the pipe 12.

The cutting head also has a bearing 24 with a rotatable component 26 that is rigidly connected to the cutter wheel 18. The rotatable bearing component 26 and the cutter wheel 18 are rotatable together around a central longitudinal axis. The bearing 24 also has a stationary component 28 that is rigidly attached to the mounting bracket 20. The bearing 24 is configured to allow the cutter wheel to be driven in rotation without rotation of the pipe. The bearing 24 is also configured to allow the pipe 12 and the cutting head to be pulled or pushed by a longitudinal (axial) force that is applied to the cutter wheel 18 and ultimately to the pipe 12 through the interposed rotatable component 26 of the bearing 24, stationary component 28 of the bearing 24 and mounting bracket 20. A reason to have the ability to occasionally push the cutting head and pipe 12 backwards is in the event that the cutter wheel 18 gets locked up because an object in the soil causes so much friction against the cutter wheel 18 that the cutter wheel 18 cannot be rotated. In that event, the cutting head and pipe can be pushed backwards to free the cutter wheel so driving in rotation can be resumed.

The preferred bearing 24 is a double tapered roller bearing for supporting both an axial load in both opposite axial directions and radial loads. By supporting an axial load the bearing 24 allows the cutting head and the pipe 12 to be pulled or pushed in an axial direction along the enlarged hole by the drive shaft 14. By supporting a radial load, the bearing 24 resists radial movement of the cutter wheel 18 with respect to the pipe 12.

A drive shaft connector 30 is attached to the cutter wheel 18 which is fixed to the rotatable component 26 of the bearing 24. Drive shaft connectors of this type are known in the prior art and are typically threaded for connecting to a mating thread on the end of a drive shaft, such as a pilot hole drive pipe. The drive shaft connector 30 is on the opposite side of the cutter wheel 18 from the mounting bracket 20. That allows the cutter wheel 18 to be attached to a pilot hole drive shaft 14, which extends through the pilot hole 16, so that rotation of the pilot hole drive shaft 14, when connected to the drive shaft connector 30, can rotate the cutter wheel 18 and pull the cutting head components and its attached pipe 12.

Because the cutting head is: (1) attached to pipe 12; (2) attached to the cutter wheel 18; and (3) allows the cutter wheel 18 to rotate without rotating the pipe 12, the cutting head of the invention permits independent rotational drive of only the cutter wheel while permitting pulling of the pipe and the cutter wheel by a drive shaft that is a pilot rod or a pilot drive pipe. Unlike the prior art, the auger 10 does not rotate the cutter wheel 18 of the cutting head. The cutting head is pulled through the pilot hole by a second rig. However, the operation can still be augmented by pushing (jacking) the auger 10 and casing pipe 12. Because the cutting head is pulled by a drive shaft that extends through the pilot hole, the cutter wheel of the cutting head is guided or steered by the pilot hole and follows the pilot hole. To the extent that the axis of the rotating cutter wheel would slightly misalign away from the desired path along the pilot hole, the parts of the cutting head can bend enough, without exceeding their elastic limit, so the cutter wheel is pulled back onto the path of the pilot hole by the radial force applied from the drive shaft that is rotating within the pilot hole.

As shown in FIG. 2, the drive shaft 14 is preferably a drive pipe having a central passage 32. The use of a drive pipe permits liquid to be pumped through the passage 32 of the drive pipe and out through radial holes 34 that are positioned immediately ahead of the cutter wheel 18. Liquid that is pumped in through the drive pipe passage 32 assists in transporting cuttings away from the cutter wheel 18 and into the auger 10 as well. A valve may be added behind the cutting wheel that, when opened, will allow an operator to pump Bentonite slurry to the annular space around the pipe. This slurry also reduces skin friction between the exterior surface of the pipe and the interior wall of the hole.

Figure 3:
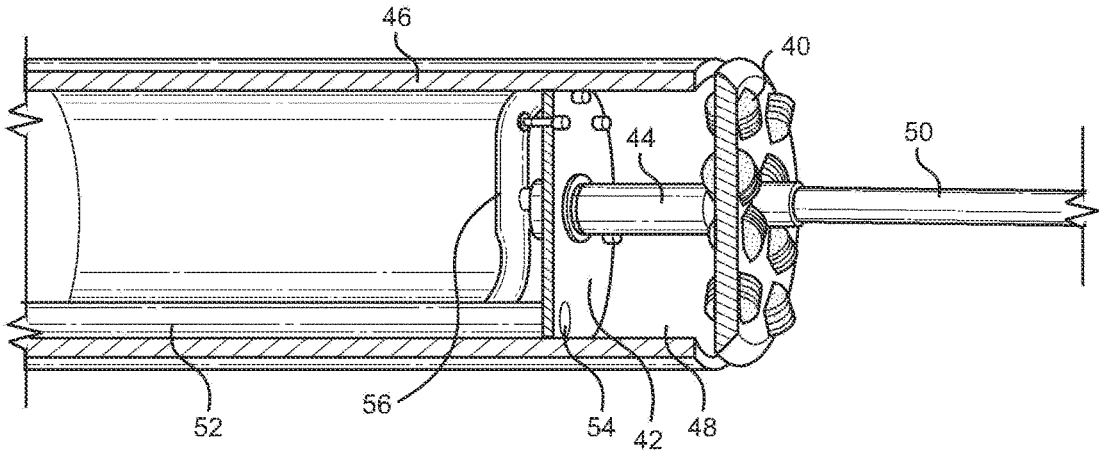
FIG. 3 is a view in section of an alternative embodiment of the invention taken substantially along the line 3-3 of FIG. 4
Figure 4:
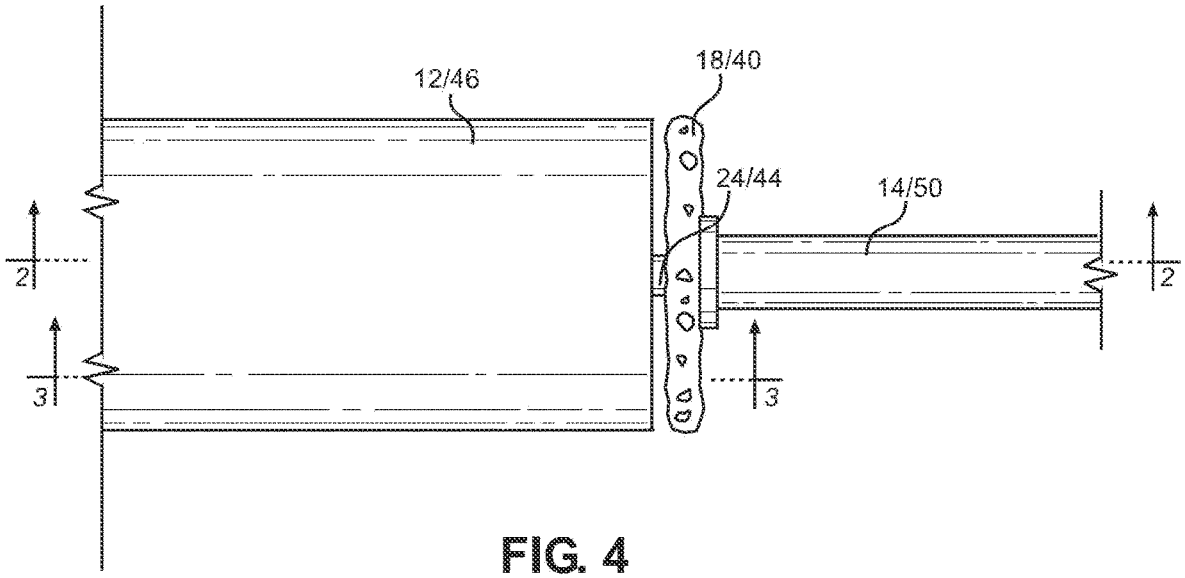
FIG. 4 is a top view of the embodiments of FIGS. 1, 2 and 3.

FIGS. 3 and 4 illustrate an alternative embodiment of the invention that can be used for a wet system without an auger in which liquid is pumped to the cutting head for the purposes described above and for conventional purposes. Like the embodiment of the invention illustrated in FIGS. 1 and 2, the embodiment of FIGS. 3 and 4 is a cutting head that includes a cutter wheel 40 that is mounted to a mounting bracket 42 through an interposed bearing 44. The bearing 44 has the same characteristics as described for the bearing 24 in the embodiment of FIGS. 1 and 2. However, the mounting bracket 42 is a circular panel that extends outwardly from a central axis of rotation by a radial distance equal to the interior radius of a pipe 46. The mounting bracket 42 is circular so that it is configured to block passage of slurry past the circular panel mounting bracket 42. Together, the pipe 46 with the cutting head mounted to the pipe form a cutting assembly for boring an enlarged hole along and following a pre-formed pilot hole. The cutting assembly has a slurry collection chamber 48 formed in the pipe 46 between the circular mounting bracket 42 and the cutter wheel 40.

For the embodiment of the invention illustrated in FIGS. 3 and 4, liquid is pumped to the cutter wheel 40 either through a drive shaft 50 that is a hollow drive pipe or through a slurry inlet pipe. If a drive pipe is used to pump slurry to the cutter wheel 40, the structure may be formed in the same manner as shown and described for the embodiment of FIGS. 1 and 2. Slurry is pumped out of the hole from the slurry collection chamber 48 through a slurry return pipe 52. The circular mounting bracket 42 has at least one hole 54 through it that is configured for attachment to the slurry return pipe 52. The slurry flows from the slurry collection chamber 48 into and through the slurry return pipe 52 to a suction pump located at the soil surface or inside the pit.

As an alternative, liquid may be pumped to the slurry collection chamber 48 and the cutter wheel 40 through a slurry inlet pipe 56. Both the slurry inlet pipe 56 and the slurry return pipe 52 extend through the pipe 46 to their respective pumping equipment at the surface. As yet another alternative, slurry can be pumped into the pilot hole and allowed to flow by gravity along the exterior of the pilot hole drive shaft 50.

Method for Laying an Underground Pipe

Figure 5:
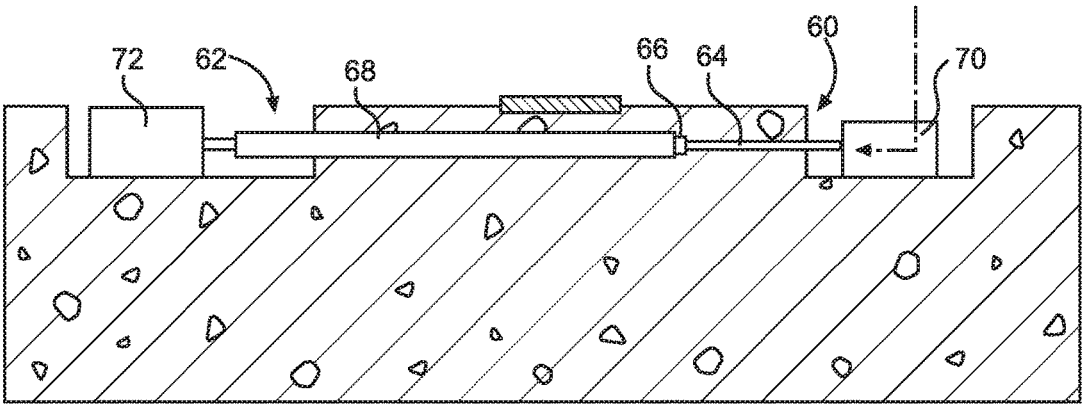
FIG. 5 is a view in vertical section of an example of embodiments of the invention being used in the process of using the apparatus of the invention for boring, drilling or tunneling under the earth's surface to form a hole from one surface location to another surface location and for placing a utility pipe or conduit through the hole.
Figure 6:
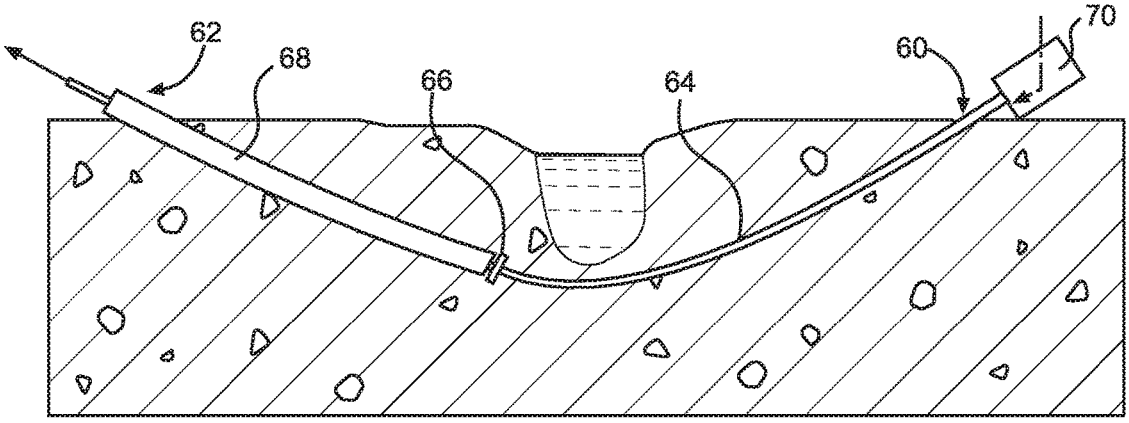
FIG. 6 is a view in vertical section of another example of embodiments of the invention being used in the process of using the apparatus of the invention for boring, drilling or tunneling under the earth's surface to form a hole from one surface location to another surface location and for placing a utility pipe or conduit through the hole.
Figure 7:
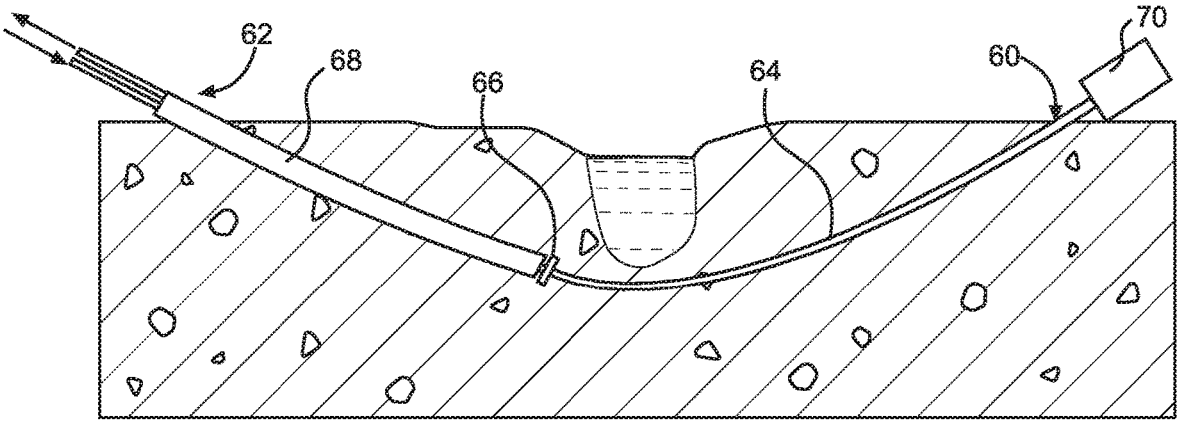
FIG. 7 is a view in vertical section of yet another example of embodiments of the invention being used in the process of using the apparatus of the invention for boring, drilling or tunneling under the earth's surface to form a hole from one surface location to another surface location and for placing a utility pipe or conduit through the hole.

The cutting heads that are described above are most advantageously used for a trenchless method according to the invention for installing an underground pipe. Referring to FIGS. 5 through 7, a pilot hole is drilled beginning from an entrance location 60 to an exit location 62. The usual manner of drilling a pilot hole is to push a pilot hole cutter wheel along the desired path of the pilot hole while rotating the cutter wheel with a pilot hole drive shaft 64, such as a pilot hole drive pipe. This step is not illustrated because it is a process that may be done using well known prior art methods and equipment. The pilot hole establishes the line and grade for an enlarged hole and pipe.

Either before or after drilling the pilot hole, the pipe 68, which is to be pulled through an enlarged hole, is attached to the mounting bracket of a cutting head that is constructed according to the invention.

After drilling the pilot hole, an end of the pilot hole drive shaft 64 is attached to the cutter wheel 66 of the cutter head that is constructed according to the invention. That cutter wheel 66 has a diameter greater than the diameter of the pipe 68 that is to be pulled through an enlarged hole that will be enlarged by the cutter wheel 66. Preferably the attachment of the cutter wheel 66 to the drive shaft 64 is performed at the exit location 62 of the pilot hole because, immediately after the pilot hole is drilled, the end of the pilot hole drive shaft 64 that has a fitting for connecting to a pilot hole cutter wheel is in position at the exit location 62. Also, the opposite end of the pilot hole drive shaft is already connected to machinery 70 for rotating and pulling the drive shaft 64. Although the drive shaft 64 can instead first be withdrawn and/or refitted, connecting the cutter wheel 66 of the cutting head at the exit location 62 avoids those extra steps.

The pilot hole is then enlarged to receive the pipe 68 by simultaneously: (1) pulling on the cutter wheel 66 and the entire cutting head with the drive shaft 64; (2) rotating the cutter wheel 66 with the drive shaft; and (3) pulling on the pipe 68 with the drive shaft 64 without rotating the pipe 68. With these simultaneous operations, the cutter wheel 66 advances along the pilot hole and the pipe 68 is simultaneously advanced through the enlarged hole immediately behind the cutter wheel 66.

Referring to FIG. 5, the method may be used with a pipe 68 that is a casing pipe which surrounds an auger. The auger is pushed and rotated from the exit location 62 by conventional auger drilling machinery 72 while simultaneously the cutter wheel 66 and the casing pipe 68 are simultaneously pulled from the entrance location 60 and the cutter wheel 66 is rotated all by the conventional machinery 70. The pipe 68 can also additionally be pushed or jacked from the exit location simultaneously with the other pushing, pulling and rotating operations.

The above trenchless method can also be used in combination with the application of slurry to the cutter wheel 66. The drive shaft 64 can be a drive pipe so that slurry can be pumped through the drive shaft 64 to the cutter wheel 66 while rotating the cutter wheel and pulling the pipe. Slurry can alternatively be transported from the earth or pit surface to the cutter wheel 66 through the pilot hole so it flows around the outside of the drive shaft 64.

For an auger system, the slurry can be transported away from the cutting head along with the cuttings carried in the slurry by rotation of the auger. For other systems the slurry can be suction pumped away from the cutter wheel through a slurry return pipe that extends through the pipe from an end that is in fluid communication with the cutter wheel to an opposite end outside an open end of the pipe.

Instead of pumping the slurry in through the drive pipe or the pilot hole, the slurry can be pumped in through a separate slurry inlet pipe that also extends through the pipe. Additionally, a small amount of slurry can be pumped along the outside of the pipe as it is pulled into the enlarged hole in order to provide lubrication for reducing skin friction that resists advancement of the pipe along the hole. The use of the slurry return pipe inside of another pipe assures that there will be no fracking into streams or other environmental features because the slurry is drawn out and therefore does not collect in the hole so there is no hydraulic pressure in the hole that might cause fracking.

Some prior art systems use a crusher, such as a cone crusher, to reduce the size of the cuttings before they are transported out of the hole. In particular a crusher may be used when slurry is used to carry the cuttings through an exit pipe. If desired or needed, a crusher of the type known in the prior art may also be used with the invention.

Improvements from the Invention

The summary of the invention states that the invention provides an apparatus and a method for permitting the simultaneous combination of: (1) pulling and rotating a cutter wheel to ream and enlarge a horizontal pilot hole; (2) pulling a pipe along behind the cutter wheel through the enlarged hole as it is being enlarged; (3) using one drive shaft to simultaneously do the pulling and rotating operations; and (4) doing those operations with that drive shaft extending through a pilot hole.

With the invention, the track accuracy of the hole is improved because the cutter wheel and the pipe are both pulled through the pilot hole in a manner that causes the pilot hole to act as a guide that steers the cutting wheel along the pilot hole and therefore provides more accuracy than merely pushing those components. Fewer operations are necessary. The drive shaft for the pilot hole is already in the hole at the end of the pilot hole drilling operation so there is no need to replace or refit the pilot drive shaft. The machine for rotating the pilot drive shaft is already in place connected to the drive shaft at the pilot hole entrance end because the machine for rotating the pilot drive shaft was used in the previous operation to drill the pilot hole. Therefore, time is saved because workers need only to connect the cutting head and the pipe to which it is connected to the pilot drive shaft at the exit end of the pilot hole. However, the drive shaft that was used for cutting the pilot hole can be pulled out and replaced by a larger drive shaft that can operate at a higher torque if a larger diameter hole is to be drilled as the cutter wheel and the pipe are to be pulled through the pilot hole The invention also permits the use of an auger system in situations where more costly systems are conventionally required because the invention more accurately guides the auger because of the guidance from the pilot hole. Because the auger system is more accurately guided, labor operations, and therefore labor costs, are reduced because the auger and its casing pipe do not need to be periodically removed during the boring operation in order to allow workers to enter the partially bored hole and perform operations for diverting a misdirected boring path back to a proper course. Slurry can be fed into the bore hole through the already installed pilot hole drive pipe for lubricating the cutter wheel and assisting in the removal of cuttings without the danger of fracking because the slurry can be returned to the surface by the auger or by pumping the slurry out through slurry return pipes that extend through the pipe.

This invention allows a contractor to pull a microtunnel style machine in lieu of pushing. This will eliminate problems encountered with the microtunnel's crushing chamber becoming packed or clogged and would eliminate most of the heavy mechanicals inside of the microtunnel machine, such as the large rotary motor steering cylinders and guidance equipment.

This invention allows a contractor to shoot a pilot hole on a long auger bore and pull while the material is being augered out on the other end. The pilot hole drill pipe provides a reliable liquid conductor to the face of the cut as well as behind the cutter wheel. This provides fluid to keep the cutters clean, cool and efficient while also allowing the contractor to pump a Bentonite slurry mix to the annular space to reduce skin friction. This method also allows a contractor to overcut the hole due to being pulled rather than being pushed.

This invention gives a contractor the capability to rotate and cut the hole while pulling the pipe simultaneously. This eliminates frac-outs due to the cuttings being directed to the slurry pipes inside the product pipe.

LIST OF COMPONENT REFERENCE NUMBERS

FIGS. 1 and 2
10 auger
12 pipe
14 drive shaft
16 pilot hole
18 cutter wheel
20 mounting bracket
22 radial arms of mounting bracket 20
24 bearing
26 rotatable component of bearing 24
28 stationary component of bearing 24
30 drive shaft connector
32 central passage of drive shaft 14
34 radial passages at the inner end of drive shaft 14.
FIGS. 3 and 4
40 cutter wheel
42 mounting bracket
44 bearing
45 rotatable component of bearing
46 pipe
47 stationary component of bearing
48 slurry collection chamber
50 drive shaft
52 slurry return pipe
54 hole for slurry return pipe
56 slurry inlet pipe
FIGS. 5 through 7
60 entrance location
62 exit location
64 pilot hole drive shaft
66 cutter wheel
68 pipe
70 machinery for pulling and rotating a drive shaft
72 auger drilling machinery This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A cutting head for attachment at an end of a pipe and for pulling on the pipe with a pilot hole drive shaft extending through a pre-formed pilot hole, the cutting head comprising:

(a) a mounting bracket having a central axis and configured for attachment of the cutting head to the pipe, the mounting bracket having at least two radially oriented arms each arm rigidly attached to the mounting bracket and extending radially outwardly from the central axis by a radial distance equal to an interior radius of the pipe and configured for attachment to an interior wall of the pipe, the arms being spaced apart so that cuttings can pass between them;

(b) a cutter wheel having a radius larger than a radius of the pipe so the pipe can be pulled along an enlarged hole being bored by the cutter wheel, the cutter wheel having holes or passages configured to pass cuttings through the holes or passages into the pipe;

(c) a bearing having a rotatable component connected to the cutter wheel and rotatable around a central axis and having a stationary component attached to the mounting bracket, the bearing configured to allow the cutter wheel to be driven in rotation without rotation of the pipe; and (d) a drive shaft connector on an opposite side of the cutter wheel from the mounting bracket for attachment of the cutter wheel to the pilot hole drive shaft and configured so that rotation of the pilot hold drive shaft, when connected to the drive shaft connector, rotates the cutter wheel.

2. A cutting head for attachment at an end of a pipe and for pulling on the pipe with a drive shaft extending through a pre-formed pilot hole, the cutting head comprising:

(a) a mounting bracket configured for attachment of the cutting head to the pipe, wherein the mounting bracket extends radially outwardly from the central axis by a radial distance equal to an interior radius of the pipe and is configured for attachment to an interior wall of the pipe;

(b) a cutter wheel having a radius larger than a radius of the pipe so the pipe can be pulled along an enlarged hole being bored by the cutter wheel;

(c) a bearing having a rotatable component connected to the cutter wheel and rotatable around a central axis and having a stationary component attached to the mounting bracket, the bearing configured to allow the cutter wheel to be driven in rotation without rotation of the pipe; and (d) a drive shaft connector on an opposite side of the cutter wheel from the mounting bracket for attachment of the cutter wheel to a pilot hole drive shaft and configured so that rotation of the drive shaft, when connected to the drive shaft connector, rotates the cutter wheel;

wherein the mounting bracket comprises a circular panel extending outwardly from the central axis by the radial distance equal to the interior radius of the pipe and configured for blocking passage of slurry past the panel, the panel also having at least one hole through the panel and configured for attachment to a slurry return pipe for permitting passage of slurry through the slurry return pipe.

3. A cutting head according to claim 2 wherein the bearing is a double tapered bearing for supporting both an axial load and a radial load in order to allow the cutting head and the pipe, when attached to the mounting bracket, to be pulled or pushed axially along the enlarged hole by the drive shaft and to resist radial movement of the cutter wheel with respect to the pipe.

4. A cutting assembly for boring an enlarged hole along and following a pre-formed pilot hole, the cutting assembly comprising:

(a) a pipe for being installed in the enlarged hole;

(b) a mounting bracket having a central axis and attached to the pipe wherein the mounting bracket has at least two radially oriented arms rigidly attached to the mounting bracket each extending outwardly from the central axis by the radial distance equal to the interior radius of the pipe into connection to an interior wall of the pipe, the arms being spaced apart so that cuttings can pass between them;

(c) a cutter wheel having a radius larger than a radius of the pipe so the pipe can be pulled along the enlarged hole being bored by the cutter wheel, the cutter wheel having holes or passages configured to pass cuttings through the holes or passages into the pipe;

(d) a bearing having a rotatable component connected to the cutter wheel and rotatable around a central axis and having a stationary component attached to the mounting bracket, the bearing configured to allow the cutter wheel to be driven in rotation without driving the pipe in rotation;

(e) a drive shaft connector attached to an opposite side of the cutter wheel from the mounting bracket; and (f) a drive shaft extending through the pilot hole into connection with the drive shaft connector, the drive shaft and the drive shaft connector configured to rotate the cutter wheel by rotation of the drive shaft and to pull or push on the cutting assembly in response to pulling or pushing on the drive shaft.

5. A cutting assembly for boring an enlarged hole along and following a pre-formed pilot hole, the cutting assembly comprising:

(a) a pipe for being installed in the enlarged hole;

(b) a mounting bracket attached to the pipe;

(c) a cutter wheel having a radius larger than a radius of the pipe so the pipe can be pulled along the enlarged hole being bored by the cutter wheel;

(d) a bearing having a rotatable component connected to the cutter wheel and rotatable around a central axis and having a stationary component attached to the mounting bracket, the bearing configured to allow the cutter wheel to be driven in rotation without driving the pipe in rotation;

(e) a drive shaft connector attached to an opposite side of the cutter wheel from the mounting bracket; and (f) a drive shaft extending through the pilot hole into connection with the drive shaft connector, the drive shaft and the drive shaft connector configured to rotate the cutter wheel by rotation of the drive shaft and to pull or push on the cutting assembly in response to pulling or pushing on the drive shaft;

wherein the mounting bracket comprises a circular panel extending outwardly from the central axis to a connection to an interior wall of the pipe and configured for blocking passage of slurry past the panel, the panel also having at least one hole through the panel and configured for attachment to a slurry return pipe for permitting passage of slurry through the slurry return pipe.

6. A cutting assembly according to claim 5 wherein the bearing is a double tapered bearing for supporting both an axial load and a radial load in order to allow the cutter wheel and the pipe, when attached to the bracket, to be pulled or pushed axially along the hole by the drive shaft and to resist radial movement of the cutter wheel with respect to the pipe.

7. A cutting assembly according to claim 5 wherein the cutting assembly further includes a slurry return pipe connected to the hole in the circular panel and extending through the pipe to a suction pump configured for pumping slurry out of the cutting assembly.

8. A cutting assembly according to claim 7 wherein the drive shaft is a drive pipe configured for conveying slurry pumped through the drive pipe to the cutter wheel.

9. A trenchless method for laying an underground product pipe, the method comprising:

(a) drilling a pilot hole from an entrance location to an exit location with a pilot hole cutter wheel rotated by a pilot hole drive shaft that is a drive pipe;

(b) attaching an end of the pilot hole drive shaft at the exit location to a cutter wheel having a diameter greater than the product pipe;

(c) attaching the product pipe to the cutter wheel through a bearing interposed between the cutter wheel and a mounting bracket attached to the product pipe, the bearing having a rotatable component connected to the cutter wheel and rotatable around a central axis and having a stationary component attached to the mounting bracket, the bearing allowing the cutter wheel to be driven in rotation without rotation of the product pipe; and (d) simultaneously (i) enlarging the pilot hole by pulling on the cutter wheel with the drive shaft and rotating the cutter wheel with the drive shaft to form an enlarged hole;

(ii) pulling on the product pipe with the drive shaft without rotating the product pipe;

(iii) pulling the cutter wheel and the product pipe along the pilot hole from the entrance location in a direction from the exit location to the entrance location;

(iv) simultaneously pushing the product pipe while the product pipe is being pulled and the cutter wheel is being rotated; and (v) pumping slurry away from the cutter wheel and out through the product pipe;

whereby the cutter wheel advances along the pilot hole and the product pipe is simultaneously advanced through the enlarged hole immediately behind the cutter wheel.

10. A method according to claim 9 wherein the method further comprises pumping slurry away from the cutter wheel and out of the product pipe through a slurry return pipe extending along and within the product pipe.

11. A method according to claim 9 wherein the method further comprises pumping the slurry in to the cutter wheel through a separate slurry inlet pipe extending along and within the product pipe.

* * * * *